US005687587A

United States Patent [19]

Michel

[11] Patent Number: 5,687,587

[45] Date of Patent: Nov. 18, 1997

[54] ELASTIC DOUBLE-KNIT FABRIC

[75] Inventor: Gerard Henri Ferdinand Michel, Meyrin, Switzerland

[73] Assignee: E. I. Du Pont de Nemours and Company, Wilmington, Del.

[21] Appl. No.: 530,129

[22] PCT Filed: Apr. 12, 1994

[86] PCT No.: PCT/US94/03992

§ 371 Date: Nov. 28, 1995

§ 102(e) Date: Nov. 28, 1995

[87] PCT Pub. No.: WO94/24352

PCT Pub. Date: Oct. 27, 1994

[30] Foreign Application Priority Data

Apr. 17, 1993 [DE] Germany ..... 9305795 U

[51] Int. Cl.[6] ..... D04B 7/04

[52] U.S. Cl. ..... 66/196; 66/197; 66/200; 66/202

[58] Field of Search ..... 66/196, 197, 200, 66/202, 8, 19, 28

[56] References Cited

U.S. PATENT DOCUMENTS 4,062,204 12/1977 Segundo et al. ..... 66/196

FOREIGN PATENT DOCUMENTS 704 681 2/1968 Belgium .
498 062 8/1992 European Pat. Off. .
2 653 789 5/1991 France .
93 05 795 8/1994 Germany .

*Primary Examiner*—James J. Bell

[57] ABSTRACT

A process for making a double-knit fabric from elastic yarns and hard yarns and the double-knit fabric product. The double-knit fabric does not have to be heat-set prior to use.

12 Claims, 1 Drawing Sheet

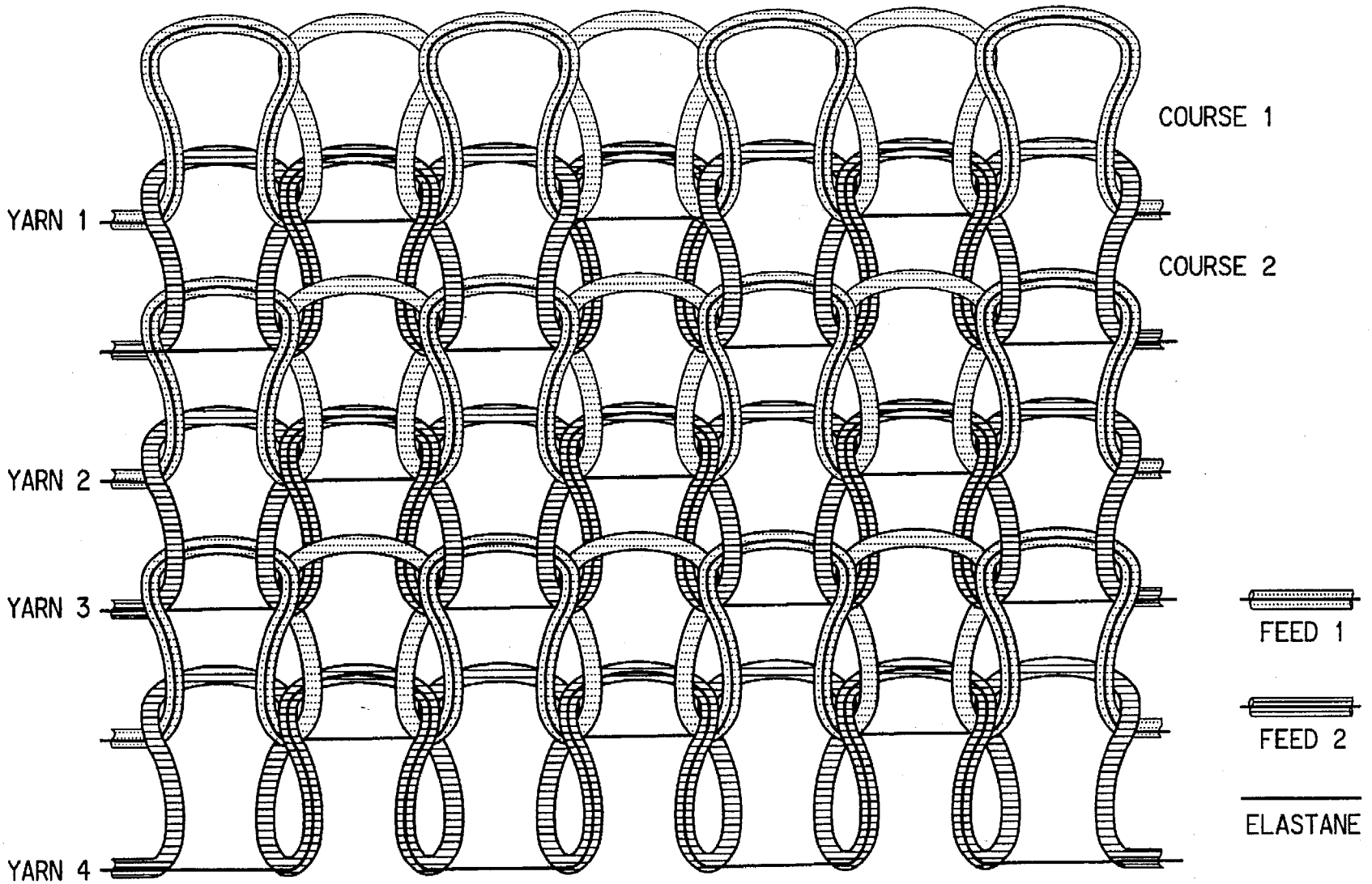
COURSE 1
COURSE 2
FEED 1
FEED 2
ELASTANE
YARN 1
YARN 2
YARN 3
YARN 4

ELASTIC DOUBLE-KNIT FABRIC

BACKGROUND OF INVENTION

1. Field of Invention

This invention relates to elastic double-knit fabrics and more particularly to elastic double-faced weft-knit fabrics.

2. Background

It is well-known to knit elastic yarns such as spandex yarns with hard yarns to produce knitted fabrics having a certain amount of "give". Heretofore, elastic double-knit fabrics have been made in one of two ways. One, the elastic yarn is plaited with a hard yarn on the same feed on both the dial and cylinder. Such a fabric is heavy, costly, and requires heat stabilization to obtain a fabric which can be used commercially. Second, it is known from BE-A-704 681 that the fabric weight and cost can be lowered by plaiting the elastic yarn with a hard yarn either on the dial or .cylinder only, and using such a plaited elastic yarn at most during every other course. However, such a fabric still must be heat-set.

It has now been found that, if the elastic yarn is plaited independently on the dial of the first feed and the cylinder of the second feed with independent hard yarns, the above-mentioned difficulties are overcome. In addition, such a new fabric has higher power at a lower elongation. For double-faced double-knit fabrics, a light-weight fabric is now possible; and it does not have to be heat-set prior to use.

SUMMARY OF THE INVENTION

According to the present invention there is provided a process for manufacturing a double-knit fabric from elastic yarns (1) and (3) and hard yarns (2) and (4) by plaiting one elastic yarn (1) with a hard yarn or filament (2) on the dial of a first feed (1), characterized in that two independent elastic yarns (1) and (3) are plaited with independent hard yarns or filaments (2) and (4), and that the second elastic yarn (3) is plaited with a second hard yarn or filament (4) on the cylinder of a second feed (2).

BRIEF DESCRIPTION OF THE DRAWINGS

The drawing diagrammatically illustrates the first six courses of a double knit plain rib fabric produced on a circular knitting machine, with reference numerals corresponding to those provided in parentheses in the claims.

DETAILED DESCRIPTION OF THE INVENTION

In accordance with the invention, elastic yarns and hard yarns are knitted so as to provide a double-knit fabric which does not have to be heat-set after knitting. Thus, the final knitted fabric weight and width is obtained on the machine.

The terms "elastic" yarn and "hard" yarn or filament as used herein are well-known in the art. Examples of suitable "elastic" yarns including shirring elastic and various elastane fibers, particularly those sold under the tradename LYCRA. A "hard" yarn is a non-contractible yarn and there is a wide range of such yarns that can be used in this invention, both natural and synthetic. The "hard" yarn(s) or filament(s) used will be selected primarily for the visual appearance and feel of the final fabric. Suitable natural spun yarns are cotton, linen, wool, cashmere, alpaca, silk, mohair, and blends of any of them. Suitable synthetic spun yarns include polyester, polyamide, and viscose. The synthetic yarns can also be blended with natural yarns such as cotton/polyester or wool/polyester. A filament is typically a continuous filament yarn of a synthetic polymer such as a polyester or a polyamide.

The double-knit fabric of the present invention can be knitted on any of the conventional circular knitting machines used for double-knits. These machines and constructions are well-known to those skilled in the art.

As shown in the drawing, in the first, third, and fifth courses, an elastic yarn 1 is fed independently to the cylinder only of a circular knitting machine. The yarn is fed under tension with a hard yarn 2 and plaited with it. In the second fourth and sixth courses, a second elastic yarn 3 is fed under tension to the dial only of a circular knitting machine and is pieced with hard yarn 4. Courses 1 and 2 are repeated for as long as desired to make a plain rib fabric. As stated earlier, the appearance and feel of the fabric can be varied by selecting different hard yarns and by varying the dtex of the yarns used. In addition, different fabric constructions can be prepared by varying the needle selection. Constructions according to the invention will be called the "Meyrinoise Stitch".

The invention can be further illustrated by the following examples:

EXAMPLE 1

A 1/1 plain rib double-knit fabric as shown in the drawing was made on a TERROT 20-gauge circular knitting machine having a 30 inch (76.2 cm) diameter and 2×1872 needles. The elastic yarns independently fed via two separate plaiting feeders (as described in Melliand Textilberichte, vol. 73, no. 10, October 1992, pp. 812–815 (in particular §3.1 and FIG. 7)) to the dial and cylinder of the knitting machine were 78 dtex LYCRA (elastane) and the hard yarns-independently fed with the elastane yarns were 85/1 number metric (Nm) cotton. The hard yarn feed rate was 0.32 m/100 stitches; the tension of the hard yarn was ScN and of the elastic yarn 6 cN. The elongation of the elastic yarn at these machine settings was 200%. The resulting plain rib fabric contained 12% by weight elastane and 88% by weight cotton, had a finished weight of 158 g/m$^2$, and had a finished width of 170 cm. This fabric was ready for standard dyeing and finishing conditions used for hard yarns without heat-setting.

EXAMPLE 2

Using the same circular knitting machine as in Example 1, except set for an interlock construction, two 22 dtex elastane yarns and the same cotton yarns were fed independently as shown in the drawing. The hard yarn feed rate was 0.20 m/100 stitches; the tension of the hard yarn was 5 cN and of the elastic yarn 3 cN. The elongation of the elastic yarn at these machine settings was 200%. The resulting interlock fabric contained 4% by weight elastane and 96% by weight cotton, had a finished weight of 244 g/m$^2$, and had a finished width of 96 cm. This fabric was ready for standard dyeing and finishing conditions used for hard yarns without heat-setting.

What is claimed is:

1. Process for manufacturing a double-knit fabric from elastic yarns (1) and (3) and hard yarns (2) and (4) by plating one elastic yarn (1) with a hard yarn or filament (2) on the dial at a first feed (1), characterized in that two independent elastic yarns (1) and (3) are plaited with independent hard yarns or filaments (2) and (4), and that the second elastic yarn (3) is plaited with a second hard yarn or filament (4) on the cylinder at a second feed (2).

2. Process according to claim 1 wherein the elastic yarns (1) and (3) are elastane yarns.

3. Process according to claim 1 wherein the hard yarns or filaments (2) and (4) are yarns and are the same.

4. Process according to claim 1 wherein the hard yarn or filament (2) of the first feed (1) is different from the hard yarn or filament (4) of the second feed (2).

5. Process according to claim 4 wherein one of the hard yarns or filaments (2) and (4) is a continuous filament so as to provide a double-faced double knit fabric.

6. Process according to claim 2 wherein the hard yarns or filaments (2) and (4) are yarns and are the same.

7. Process according to claim 2 wherein the hard yarn or filament (2) of the first feed (1) is different from the hard yarn or filament (4) or the second feed (2).

8. Process according to claim 7 wherein one of the hard yarns or filaments (2) and (4) is a continuous filament so as to provide a double-faced double-knit fabric.

9. A double-knit fabric manufactured according to a process as claimed in any of claims 1 to 5 or 6 to 8.

10. A double-knit fabric according to claim 9 wherein the fabric has a plain rib-based construction.

11. A double-knit fabric according to claim 9 wherein the fabric has an interlock-based construction.

12. A double-knit fabric comprising ribs of elastic yarns (1) and (3) plaited with hard yarns (2) and (4), characterized in that the elastic yarns (1) and (3) in two consecutive ribs are contained in alternating faces of the fabric.

* * * * *